US011493272B2

(12) United States Patent
Hall

(10) Patent No.: US 11,493,272 B2
(45) Date of Patent: Nov. 8, 2022

(54) ROTATABLE DRYING RACK

(71) Applicant: Carissa Hall, Marietta, GA (US)

(72) Inventor: Carissa Hall, Marietta, GA (US)

( * ) Notice: Subject to any disclaimer, the term of this patent is extended or adjusted under 35 U.S.C. 154(b) by 198 days.

(21) Appl. No.: 16/910,874

(22) Filed: Jun. 24, 2020

(65) Prior Publication Data

US 2021/0404743 A1 Dec. 30, 2021

(51) Int. Cl.

| | |
|---|---|
| ***F26B 7/00*** | (2006.01) |
| ***F26B 11/18*** | (2006.01) |
| ***F26B 25/00*** | (2006.01) |

(52) U.S. Cl.

CPC ..... *F26B 11/18* (2013.01); *F26B 25/003* (2013.01)

(58) Field of Classification Search

CPC ..... F26B 11/18; F26B 25/003; F26B 25/185; F26B 9/10; F26B 11/0427

USPC ..... 32/442, 437, 439–441

See application file for complete search history.

(56) References Cited

U.S. PATENT DOCUMENTS

| | | | | |
|---|---|---|---|---|
| 1,730,125 | A * | 10/1929 | Craig | F26B 11/18 34/664 |
| 2005/0204579 | A1* | 9/2005 | Rosseau | A47L 23/20 34/104 |
| 2009/0211994 | A1* | 8/2009 | Yang | A47L 19/04 211/41.3 |
| 2018/0310711 | A1* | 11/2018 | Kuhn | A47B 88/437 |

OTHER PUBLICATIONS

Google website: https://www.google.com/search (Year: 2022).*

* cited by examiner

*Primary Examiner* — John P McCormack
(74) *Attorney, Agent, or Firm* — Taylor English Duma LLP

(57) ABSTRACT

Example aspects of a drying rack, a rotatable drying rack, and a method of drying wet objects are disclosed. The drying rack can comprise a base and a plurality of mounting post assemblies mounted to the base, each of the mounting post assemblies comprising at least one mounting post. The mounting post assemblies can comprise inner post assembly comprising an inner post and an outer post assembly comprising a primary outer post and a secondary outer post, wherein each of the inner post, primary outer post, and secondary outer post are configured to support an object above the base.

18 Claims, 7 Drawing Sheets

ROTATABLE DRYING RACK

TECHNICAL FIELD

This disclosure relates to support racks. More specifically, this disclosure relates to rotatable drying rack for supporting drying objects.

BACKGROUND

Drying racks for supporting objects as they dry, such as cups, often comprise one or more arms configured to support the objects above a surface (e.g., a table top.) In some cases, the drying racks can be used to support drying objects during manufacturing of the objects. Racks can be limited in size, and therefore, the number of objects supported by the rack can be limited. This can result in slower production times. Furthermore, the racks are typically stationary, and it can be difficult to access objects on a far side of the rack.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is drying rack comprising a base; a plurality of mounting post assemblies mounted to the base, each of the mounting post assemblies comprising at least one mounting post, the mounting post assemblies comprising: an inner post assembly comprising an inner post; and an outer post assembly comprising a primary outer post and a secondary outer post, wherein each of the inner post, primary outer post, and secondary outer post are configured to support an object above the base.

Also disclosed is a rotatable drying rack comprising a pedestal configured to rest on a support surface; a base; a rotation mechanism rotatably coupling the base to the pedestal, wherein the base is configured to rotate relative to the pedestal; and a mounting post assembly mounted to the base, the mounting post assembly comprising a mounting post configured to support a wet object above the base for drying.

A method of drying wet objects is also disclosed, the method comprising providing a drying rack, the drying rack comprising a base rotatably coupled to a pedestal and a plurality of mounting post assemblies mounted to the base; mounting a first wet object to a first one of the plurality of mounting post assemblies; rotating the base relative to the pedestal to reposition a second one of the plurality of mounting post assemblies closer to a user; mounting a second wet object to the second one of the plurality of mounting post assemblies; and removing each of the first wet object and second wet object from the drying rack once the first and second wet objects have dried.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1A:
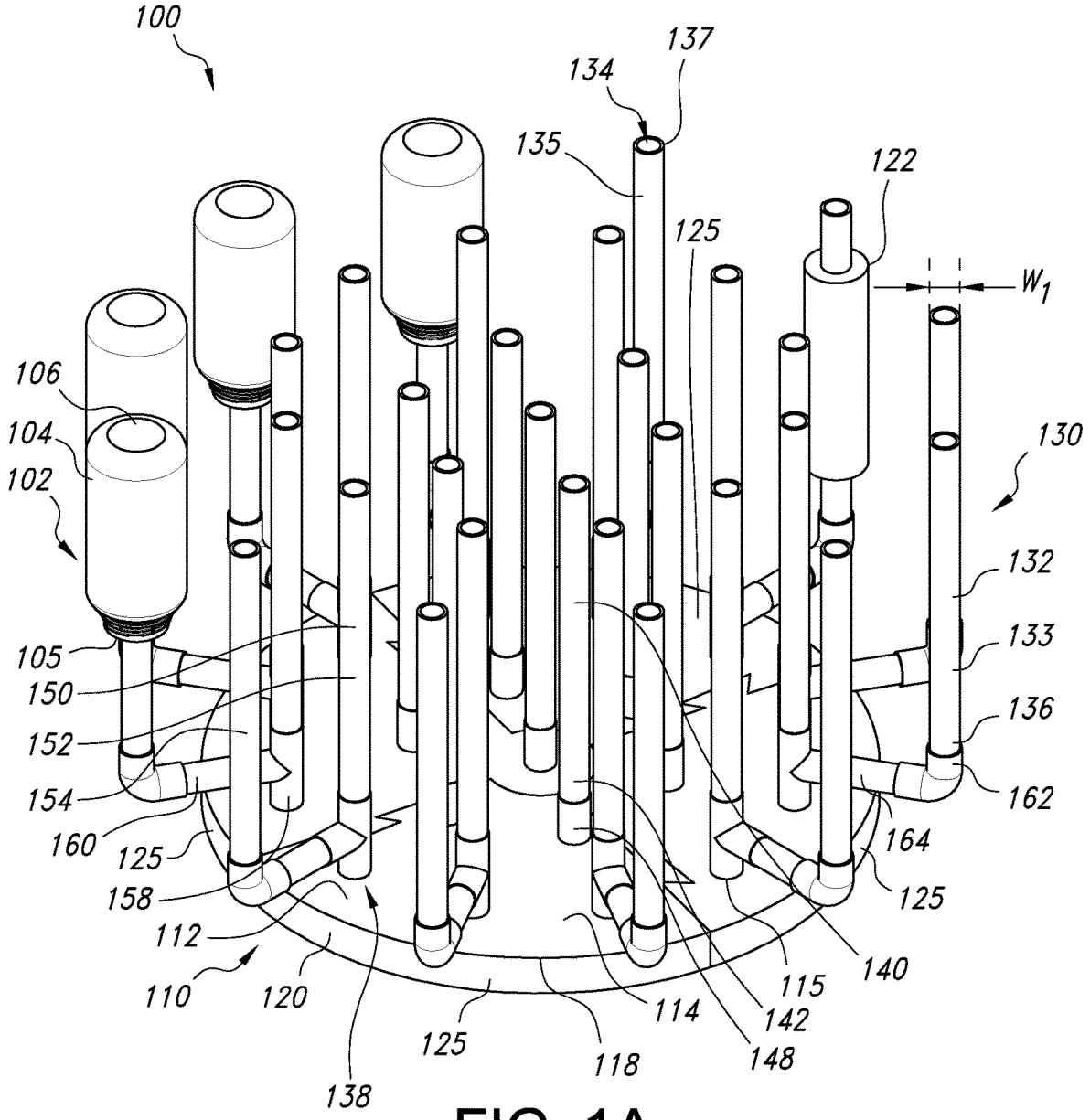
FIG. 1A is a top perspective view of a drying rack in an assembled configuration, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a drying rack and associated methods, systems, devices, and various apparatus. Example aspects of the drying rack can comprise a base and a plurality of mounting post assemblies extending from the base. The mounting post assemblies can be configured to support objects above the base. In some aspects, the base can be rotatably mounted to a pedestal. It would be understood by one of skill in the art that the drying rack is described in but a few exemplary embodiments among many. No particular terminology or description should be considered limiting on the disclosure or the scope of any claims issuing therefrom.

FIG. 1A is a top perspective view of a drying rack 100, in accordance with one aspect of the present disclosure. The drying rack 100 can be configured to support objects above a support surface (e.g., a tabletop). In one particular example aspect, the drying rack 100 can be configured to support wet objects, such as, for example, wet tumbler cups 102, during a drying step of a manufacturing process. For example, the drying rack 100 can be configured to support the tumbler cups 102 above the support surface after an outer coating, such as, for example, an epoxy coating, has been applied to an outer tumbler surface 104 of each of the tumbler cups 102, such that the outer coating can remain untouched until fully dried. In other aspects, the drying rack 100 can be configured to support any other suitable objects above the support surface for drying or for any other suitable purpose.

As shown, example aspects of the drying rack 100 can comprise a base 110 and a plurality of mounting post assemblies 130 extending generally upward (i.e., in a substantially vertical direction) therefrom, relative to the orientation shown. The mounting post assemblies 130 can be configured to support the tumbler cups 102 above the base 110. According to example aspects, the base 110 can define a substantially circular shape. However, in other aspects, the base 110 can define any other suitable shape, including but not limited to, triangular, rectangular, and the like. Example aspects of the base 110 can comprise a base body 112, and the base body 112 can define an upper surface 114 and an opposite lower surface 616 (shown in FIG. 6). In some aspects, an annular outer base sidewall 120 can extend generally downward from the base body 112, relative to the orientation shown, at an outer edge 118 of the base body 112. For example, in the present aspect, the outer base sidewall 120 can extend from the upper surface 114 to the lower surface 616, and can extend further downwards past the lower surface 616. The base 110 can be formed from a rigid material, such as, for example, a hard plastic. In other aspects, however, the base 110 can be formed from any other suitable rigid material, including but not limited to, wood, metal, composites, and the like. In some aspects, the base 110 can comprise a plurality of base sections 125, which can be interconnected in an assembled configuration, as shown. According to example aspects, some or all of the base sections 125 can be selectively disconnected from one another in a disassembled configuration or a partially disassembled configuration, as shown in FIG. 2. The base sections 125 are described in further detail below with reference to FIGS. 1B and 2. Furthermore, in some example aspects of the drying rack 100, the base 110 can be rotatably mounted to a pedestal 230 (shown in FIG. 2) by a rotation mechanism 250 (shown in FIG. 2), as described in further detail below.

In the present aspect, the mounting post assemblies 130 can comprise a plurality of inner post assemblies 140 and a plurality of outer post assemblies 150. Each of the inner post assemblies 140 and outer post assemblies 150 can comprise one or more mounting posts 132. For example, each of the inner post assemblies 140 can comprise an inner post 142, and each of the outer post assemblies 150 can comprise a primary outer post 152 and a secondary outer post 154 generally cantilevered from the primary outer post 152. According to example aspects, each of the mounting post assemblies 130 can be coupled to the base body 112 of the base 110 and can extend generally upward from the upper surface 114 thereof. For example, as shown, in the present aspect, the base 110 can define a plurality of post openings 115, and each of the mounting post assemblies 130 (i.e., each of the inner post assemblies 140 and outer post assemblies 150) can engage a corresponding one of the post openings 115 to couple the mounting post assemblies 130 to the base 110. In some aspects, some or all of the post openings 115 can be formed as blind holes, and in some aspects, such as the present aspect, some or all of the post openings 115 can be formed as through-holes. In other aspects, the mounting post assemblies 130 may be mounted to the base 110 by any other suitable method known in the art. For example, in a particular aspect, the mounting post assemblies 130 may be adhered to the upper surface 114 of the base body 112 by an adhesive.

As shown, according to example aspects, each of the mounting post assemblies 130 can comprise a socket 138, and each of the sockets 138 can engage a corresponding one of the post openings 115 of the base body 112. For example, in the present aspect, each of the inner posts 142 can engage a cylindrical socket 148, and each of the primary and secondary outer posts 152,154 can engage a tee socket 158. However, other aspects may not comprise the sockets 138, and some or all of the inner posts 142 and primary and secondary outer posts 152,154 can engage the post openings 115 directly. In some aspects, the mounting post assemblies 130 can be secured within the corresponding post openings 115 via a friction fit. Moreover, in some aspects, one or more fasteners can also or alternatively be provided for securing each of the mounting post assemblies 130 to the base 110. For example, the fastener(s) can be an adhesive, such as glue. In other aspects, the fasteners can include screws, rivets, pins, welding, or the like.

In the present aspect, each of the mounting posts 132 (i.e., the inner posts 142, primary outer posts 152, and secondary outer posts 154) can define a substantially tubular structure. For example, in some aspects, each of the mounting posts 132 can comprise a pipe 133 defining a cylindrical, hollow interior 134. As shown, in the present aspect, each of mounting posts 132 can define an upper post end 135 and lower post end 136. Each of the upper post ends 135 can define an upper opening 137 allowing access to the hollow interior 134 of the pipe 133. However, in other aspects, the mounting posts 132 can be closed at the upper post ends 135 thereof or may comprise a cap configured to cover the upper opening 137. Furthermore, each of the inner posts 142 and primary outer posts 152 can be configured to engage a corresponding one of the sockets 138 (e.g., the cylindrical socket 148 and the tee socket 158, respectively) at the lower post end 136 thereof. As shown, each of the outer post assemblies 150 can further comprise a post connector 160 for coupling the secondary outer post 154 to the corresponding tee socket 158. In example aspects, each of the post connectors 160 can comprise an elbow fitting 162 configured to engage the lower post end 136 of the corresponding secondary outer post 154 and a substantially straight fitting 164 extending between the elbow fitting 162 and the tee socket 158. Each of the elbow fittings 162 can generally define an L-shape and can be positioned such that the corresponding secondary outer posts 154 can be oriented substantially parallel with the primary outer posts 152 and the inner posts 142. In other aspects of the drying rack 100, some or all of the inner post assemblies 140 can be configured substantially the same as the outer post assemblies 150, or vice versa, or both. Moreover, in some aspects, some or all of the inner post assemblies 140 and outer post assemblies 150 can be alternatively configured, provided that each of the inner and outer post assemblies 140,150 comprises at least one mounting post 132 for supporting a tumbler cup 102 or other object above the support surface.

According to example aspects, each of the mounting posts 132 can be formed from any substantially rigid material suitably for supporting a tumbler cup 102 or other object above the base 110. For example, in some aspects, some or all of the mounting posts 132 can be formed from a plastic material, such as PVC (polyvinyl chloride). In the present aspect, each of the mounting posts 132 can be formed from a section of PVC piping. In other aspects, the mounting posts 132 can be formed from any other suitably rigid material, including but not limited to, other plastics, wood, metal, composites, and the like. Additionally, in the present aspect, each of the sockets 138 and post connectors 160 can be formed from a rigid plastic material, such as PVC. However, in other aspects, some or all of the sockets 138 and post connectors 160 can be formed from any other suitably rigid material, such as other plastics, wood, metal, composites, and the like.

Example aspects of the tumbler cups 102 can define an open first end 105 and a hollow interior (not shown). Each of the mounting posts 132 can be received through the open first end 105 and extend into the hollow interior of a corresponding one of the tumbler cups 102. A closed bottom 106 of the tumbler cup 102 can rest on the upper post end 135 of the corresponding mounting post 132 to support the tumbler cup 102 above the base 110, as shown. In some aspects, some or all of the mounting post assemblies 130 (e.g. the inner post assemblies 140 and outer post assemblies 150) can comprise a stabilizing sleeve 122 mounted on the corresponding mounting posts 132 (e.g., the inner posts 142 and the primary and secondary outer posts 152,154.) For example, as shown in the present aspect, the stabilizing sleeve 122 can be configured to wrap around a corresponding mounting post 132 to increase a width $W_1$ of the mounting post 132. The increased width $W_1$ can aid in reducing wobbling of the tumbler cups 102 when mounted on the mounting posts 132. In some aspects, the stabilizing sleeve 122 can comprise a non-slip material that can aid in gripping an inner tumbler surface (not shown) of the tumbler cups 102. According to some example aspects, the stabilizing sleeve 122 can be formed from a Styrofoam material. In other aspects, the stabilizing sleeve 122 can be formed from any other suitable material, including, but not limited to, rubber, foam, plastic, silicone, neoprene, composites, metal, wood, and the like. In some aspects, stabilizing sleeves 122 can be provided on only some of the mounting posts 132 and/or stabilizing sleeves 122 of various thicknesses can be provided, such that the widths $W_1$ of the mounting posts 132 can vary. As such, the mounting posts 132 can be configured to stabilize and support tumbler cups 102, or other objects, of varying sizes. Still other aspects of the drying rack 100 may not comprise the stabilizing sleeve(s) 122.

Figure 1B:
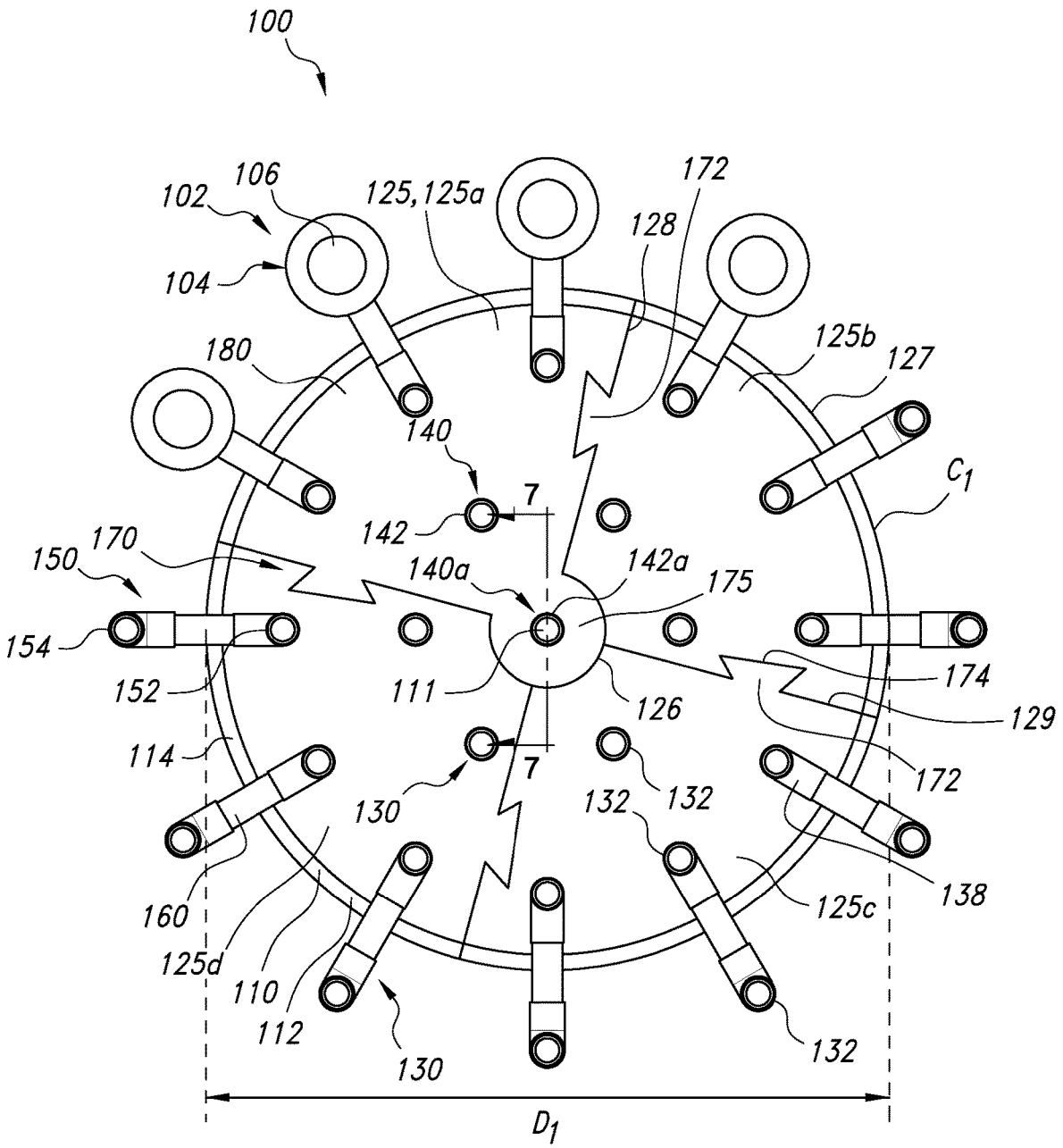
FIG. 1B is a top view of the drying rack of FIG. 1A.
Figure 2:
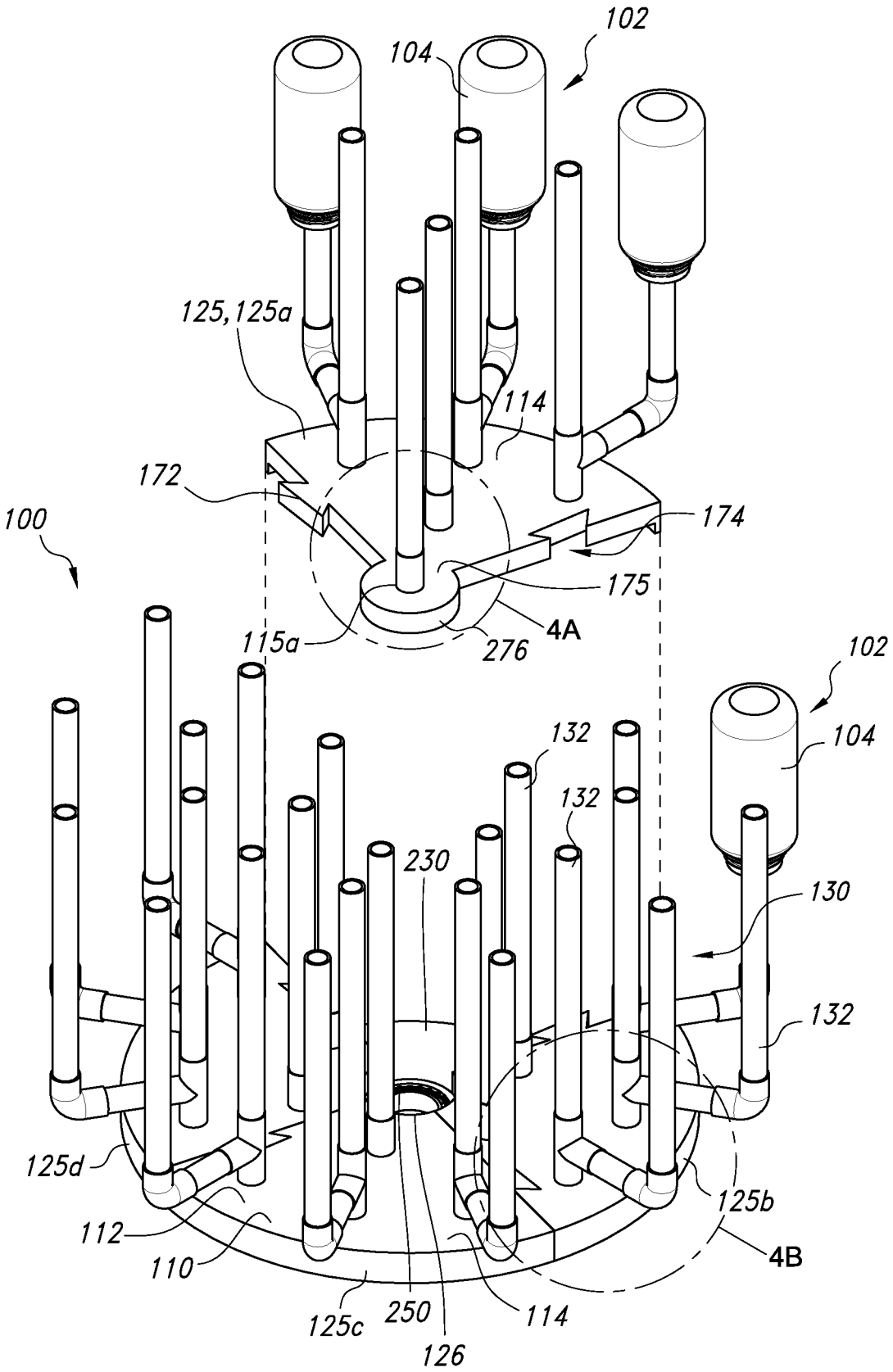
FIG. 2 is a top perspective view of the drying rack of FIG. 1A in a partially disassembled configuration, wherein a first base section thereof is removed.

Referring to FIG. 1B, each of the mounting posts 132 can be spaced apart from the surrounding mounting posts 132, such that the tumbler cups 102 supported on the mounting posts 132 do not touch one another while drying. As shown, a center one of the inner posts 142*a* can be positioned substantially at a center 111 of the base 110, and the plurality of remaining inner posts 142 can be oriented in a substantially circular pattern around the center inner post 142*a*. Furthermore, the primary outer posts 152 can be oriented in a substantially circular pattern around the inner posts 142, and the secondary outer posts 154 can be oriented in a substantially circular pattern around the primary outer posts 152. In other aspects, however, the mounting posts 132 can be oriented in any other suitably arrangement that provides a desired space therebetween. Moreover, as shown, the base 110 can define a circular shape with a base diameter $D_1$ and a base circumference $C_1$ of the base 110. According to example aspects, at least one of the mounting posts 132 can be supported above the base 110 within the base circumference $C_1$ of the base 110, and at least one of the mounting posts 132 can be supported above the base 110 outside of the base circumference $C_1$, such that not all of the tumbler cups 102 supported on the mounting posts 132 are oriented directly over the base 110. For example, in the present aspect, each of the inner posts 142 and primary outer posts 152 can be oriented within the base circumference $C_1$ (i.e., directly over the base 110), and each of the secondary outer posts 154 can be supported by the corresponding post connector 160 beyond the base circumference $C_1$ of the base 110 (i.e., not directly over the base 110). Thus, the mounting posts 132 are not limited to being oriented directly over the base 110 within the confines of the base circumference $C_1$, and as such, the drying rack 100 can be configured to support additional tumbler cups 102 without needing to increase the dimensions of the base 110. In other aspects, however, all of the mounting posts 132 can be oriented directly over the base 110 within the base circumference $C_1$.

As mentioned above, example aspects of the base 110 can be sectioned into a plurality of interconnectable base sections 125. In the present aspect, the base 110 can comprise first, second, third, and fourth base sections 125*a,b,c,d*, as shown. However, in other aspects, the base 110 can comprise more or fewer base sections 125. As shown, each of the first, second, third, and fourth base sections 125*a,b,c,d* can substantially define an inner end 126, and outer end 127 opposite the inner end 126, a first side 128, and a second side 129 opposite the first side 128. According to example aspects, the annular outer base sidewall 120 (shown in FIG. 1A) of the base 110 can be formed at the outer ends 127 of the base sections 125. Moreover, the first side 128 of each base section 125 can be configured to detachably connect with the second side 129 of an adjacent base section 125. In the present aspect, each of the base sections 125 can detachably connect to the adjacent base sections 125 by a dovetail joint 170. As shown, each of the first sides 128 of the base sections 125 can define a substantially trapezoidal dovetail pin 172 projecting therefrom, and a substantially trapezoidal dovetail tail 174 can be cut into each of the corresponding second sides 129. Each dovetail pin 172 can be configured to engage the dovetail tail 174 of an adjacent one of the base sections 125. For example, the dovetail pin 172 of the first base section 125*a* can engage the dovetail tail 174 of the fourth base section 125*d*, and the dovetail tail 174 of the first base section 125*a* can be engaged by the dovetail pin 172 of the second base section 125*b*, and so on, to interconnect all of the first, second, third, and fourth base sections 125*a,b,c,d* to define the base 110. However, in other aspects, the base sections 125 can be interconnected by any other suitable connection mechanisms known in the art. Furthermore, in other aspects, the base sections 125 may be permanently connected to one another. In still other aspects, the base 110 may not define the plurality of base sections 125.

As described, according to example aspects, each base section 125 can define the inner end 126 opposite the corresponding outer end 127. In some example aspects, the first base section 125*a* can define a base cover 175 at the inner end 126 thereof, as shown. The base cover 175 of the first base section 125*a* can be oriented at the center 111 of the base 110, and can be substantially circular in shape. In example aspects, the base cover 175 can be configured to cover a rotation mechanism 250 (shown in FIG. 2) of the drying rack 100 to prevent interference with the rotation mechanism 250, which is described in further detail below. Additionally, as shown, the inner end 126 of each of the second, third, and fourth base sections 125*b,c,d* can be configured to abut the circular base cover 175 of the first base section 125*a*. In the present aspect, the base cover 175 can define a center one of the post openings 115*a* (shown in FIG. 2), and a center one of the inner post assemblies 140*a* comprising the center inner post 142*a* can engage the center post opening 115*a* of the base cover 175. In other aspects, however, any of the first, second, third, and fourth base sections 125*a,b,c,d* can define the base cover 175, or a portion of the base cover 175. The base cover 175 can define any other suitable configuration in other aspects, provided that the base cover 175 can cover or partially cover the rotation mechanism 250 in the assembled configuration. In still other aspects, the base 110 may not define the base cover 175, and the rotation mechanism 250 may be exposed in the assembled configuration. Moreover, some aspects of the drying rack 100 may not comprise a rotation mechanism 250, and such a base cover 175 may not be pertinent. According to example aspects, each of the first, second, third, and fourth base sections 125*a,b,c,d* can be substantially similar in size and shape, though the first base section 125*a* can additionally comprise the base cover 175 in the present aspect. In other aspects, however, some or all of the base sections 125 can be dissimilar in size and/or shape.

Furthermore, in some example aspects, a protective mat 180 can be configured to rest on the upper surface 114 of the base body 112. In the present aspect, the protective mat 180 is illustrated as translucent, such that the base sections 125 beneath the protective mat 180 remain visible. As shown, the protective mat 180 can be substantially circular in the present aspect, and the protective mat 180 can cover all or most of the upper surface 114. In some aspects, the protective mat 180 can be formed as a single piece, as shown, while in other aspects, the protective mat 180 may comprise a plurality of mat sections. For example, in other aspects, the drying rack 100 may comprise a mat section mounted on each of the base sections 125. According to example aspects, the outer coating applied to the tumbler cups 102 may drip off of the tumbler cups 102 while drying. The protective mat 180 covering the upper surface 114 of the base body 112 can protect the base 110 from the dripping coating. Example aspects of the protective mat 180 can be formed from a material that can be easy to clean the coating off of, such as, for example and without limitation, silicone. In other aspects, the protective mat 180 can be formed from any other suitable material that can be easy of clean, including, but not limited to rubber, a transparent film, paper, plastic, foil, and the like.

FIG. 2 illustrates the drying rack 100 in the partially disassembled configuration, wherein the first base section 125*a* is removed from the base 110. In example aspects, the base cover 175 can define an arcuate base cover sidewall 276 extending from the upper surface 114 of the base body 112 to the lower surface 616 (shown in FIG. 6) of the base body 112. Each of the first, second, third, and fourth base sections 125*a,b,c,d* can define an arcuate inner end sidewall 326 (shown in FIG. 3) formed at the corresponding inner end 126 thereof, and each of the inner end sidewalls 326 can be configured to abut the base cover sidewall 276 in the assembled configuration (shown in FIGS. 1A and 1B). Moreover, as shown, with the first base section 125*a* removed, the rotation mechanism 250 and the pedestal 230 are visible. According to example aspects, the rotation mechanism 250 can rotatably couple the base 110 to the pedestal 230. For example, the rotation mechanism 250 can be mounted to the pedestal 230, and the base sections 125 of the base 110 can be mounted to the rotation mechanism 250, such that the base 110 is elevated above the support surface by the pedestal 230, and such that the base 110 can rotate relative to the pedestal 230. In some aspects, the base 110 can be rotated relative to the pedestal 230 to increase air flow against the tumbler cups 102, and thus decrease time it takes for the tumbler cups 102 mounted thereon to dry. For example, rotating the base 110 can cause air to move around the outer tumbler surfaces 104 of the tumbler cups 102, which can speed up the drying of the outer coating (e.g., the epoxy coating) applied to the corresponding outer tumbler surfaces 104. Furthermore, in some aspects, the base 110 can be rotated relative to the pedestal 230 to move a particular mounting post assembly 130 (or assemblies 130) or a particular base section 125 into closer proximity to a user to facilitate mounting or removing tumbler cups 102 to and from the corresponding mounting posts 132. Other aspects may not comprise the pedestal 230 and/or the rotation mechanism 250. For example, in a particular aspect, the drying rack 100 may not comprise the pedestal 230, and the rotation mechanism 250 itself can be configured to rest on the support surface.

According to example aspects, the first base section 125*a* can be detached from the base 110 by lifting the first base section 125*a* substantially upward, relative to the orientation shown, away from the pedestal 230. The dovetail pin 172 of the first base section 125*a* can disengage the dovetail tail 174 of the adjacent fourth base section 125*d*, and the dovetail tail 174 of the first base section 125*a* can disengage the dovetail pin 172 of the adjacent second base section 125*b* to disconnect the first base section 125*a* therefrom. The first base section 125*a* can be reattached to the base 110 by lowering the first base section 125*a* towards the pedestal 230 to re-engage the dovetail pin 172 and dovetail tail 174 of the first base second with the dovetail tail 174 of the fourth base section 125*d* and dovetail pin 172 of the second base section 125*b*, respectively. Each of the second, third, and fourth base sections 125*b,c,d* can be disconnected from and re-connected to the adjacent base sections 125 in substantially the same manner to partially or fully disassemble the base 110. In some aspects, each of the base sections 125 can be selectively removed from the base 110 to facilitate mounting and removing the tumbler cups 102 to and from the corresponding mounting posts 132, for cleaning of the relevant base section(s) 125, or for any other suitable purpose.

As such, referring to FIGS. 1A-2, an example method of drying the wet tumbler cups 102, or other wet objects, can comprise providing the drying rack 100, wherein the drying rack 100 can comprise the base 110 rotatably coupled to the pedestal 230, and wherein the drying rack 100 can further comprise a plurality of the mounting post assemblies 130 mounted to the base 110. The method can further comprise mounting a first one of the tumbler cups 102, while wet, to a first one of the plurality of mounting post assemblies 130, and then rotating the base 110 relative to the pedestal 230 to reposition a second one of the plurality of mounting post assemblies 130 closer to a user. The method can next comprise mounting a second one of the wet tumbler cups 102 to the second one of the plurality of mounting post assemblies 130. Finally, the method can comprise removing each of the first and second wet tumbler cups 102 from the drying rack once the first and second wet tumbler cups 102 have dried. In some aspects, the method can further comprise rotating the base 110 relative to the pedestal 230 to increase air flow around the first and second wet tumbler cups 102. In some aspects, a fan may be provided to blow air around the wet tumbler cups 102 to facilitate drying the wet tumbler cups 102. Additionally, in some aspects, the plurality of mounting post assemblies 130 can comprise a one of the inner post assemblies 140 and a one of the outer post assemblies 150, wherein the inner post assembly 140 comprises a one of the inner posts 142, and the outer post assembly 150 comprises a one of the primary outer posts 152 and a one of the secondary outer posts 154.

Figure 3:
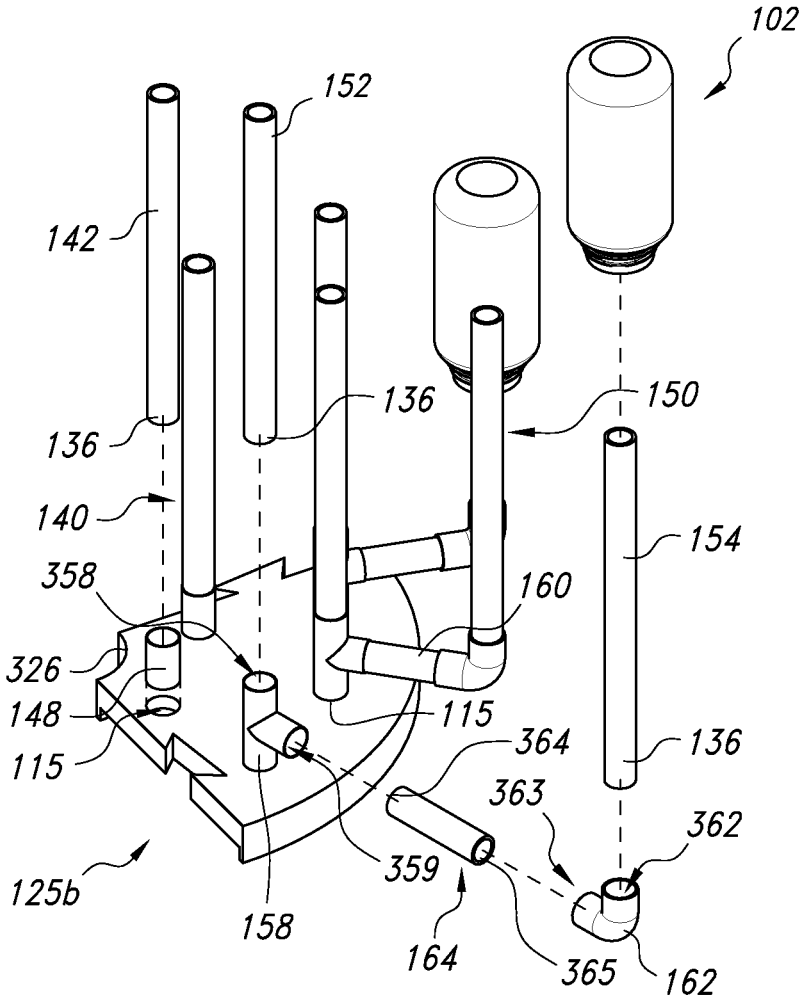
FIG. 3 is a partially exploded view of a second base section of the drying rack of FIG. 1A.

FIG. 3 illustrates a partially exploded view of the second base section 125*b* of the base 110 (shown in FIG. 1A). In the present aspect, the second base section 125*b* can comprise two of the inner post assemblies 140 and three of the outer post assemblies 150. In the present FIG. 3, a one of the inner post assemblies 140 is exploded and a one of the outer post assemblies 150 is exploded for a clear view of the corresponding components thereof. As shown, each of the inner post assemblies 140 can comprise the cylindrical socket 148 engaging a corresponding one of the post openings 115 in the second base section 125*b*, and a corresponding one of the inner posts 142 engaging the cylindrical socket 148 at its lower post end 136. Each of the outer post assemblies 150 can comprise the tee socket 158 engaging a corresponding one of the post openings 115 and a one of the primary outer posts 152 engaging a first tee opening 358 of the tee socket 158 at its lower post end 136. Each of the outer post assemblies 150 can further comprise a corresponding one of the post connectors 160 engaging a second tee opening 359 of the tee socket 158, and a corresponding one of the secondary outer posts 154 mounted to the post connector 160 at its lower post end 136.

As described above, each of the post connectors 160 can define the substantially straight fitting 164 and the substantially L-shaped elbow fitting 162. The straight fitting 164 can define a first straight fitting end 364 and an opposite second straight fitting end 365, as shown. Furthermore, the elbow fitting 162 can define a first elbow opening 362 and a second elbow opening 363. According to example aspects, the first straight fitting end 364 of the straight fitting 164 can engage the second tee opening 359 of the tee socket 158, and the second straight fitting end 365 can engage the second elbow opening 363 of the elbow fitting 162. Furthermore, the lower post end 136 of the secondary outer post 154 can engage the first elbow opening 362 of the elbow fitting 162 to mount the secondary outer post 154 to the tee socket 158 in a cantilevered fashion. The third and fourth base sections 125*c,d* (shown in FIG. 1A) can be configured substantially the same as the second base second in the present aspect, but can define a different configuration in some aspects. The first base section 125*a* (shown in FIG. 1A) can also be similarly formed in some aspects, but can further comprise the base cover 175 (shown in FIG. 1B) and the center inner post 142*a* (shown in FIG. 1B) mounted thereto. In other aspects, the first base section 125*a* can define additional differences from the second base section 125*b*.

Figure 4A:
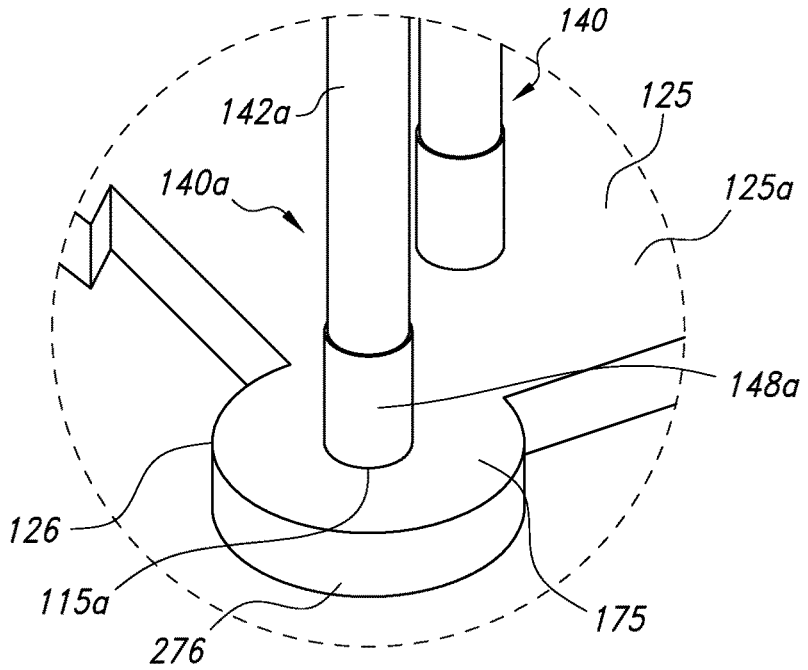
FIG. 4A is a top perspective view of Detail 4A of FIG. 2.

FIG. 4A illustrates a detail view of the base cover 175 formed at the inner end 126 of the first base section 125*a*, taken from Detail 4A of FIG. 2. As described, the base cover 175 can define a substantially circular shape, and can be oriented at the center 111 (shown in FIG. 1B) of the base 110 (shown in FIG. 1A) in the assembled configuration. In other aspects, the base cover 175 can define any other suitable shape, such as, for example, rectangular, triangular, or the like, dependent about the shape and the number of base sections 125. As shown, the arcuate base cover sidewall 276 can partially define the base cover 175. In the present aspect, the arcuate base cover sidewall 276 can define a major arc (i.e., an arc that is greater than a semi-circle). For example, the major arc can define about ¾ of a circle in the present aspect. As such, the arcuate inner end sidewall 326 (shown in FIG. 3) of each of the first, second, third, and fourth base sections 125*a,b,c,d* (second, third, and fourth base sections 125*b,c,d* shown in FIG. 1A) can define about ¼ of the circle. In other aspects, the base cover sidewall 276 may not define a major arc, dependent upon the sizing and/or shape(s) of the base sections 125. Moreover, according to example aspects, the center inner post assembly 140*a* can be mounted to the base cover 175. The center inner post assembly 140*a* can comprise a center one of the cylindrical sockets 148*a* configured to engage the center post opening 115*a* formed at a center of the base cover 175 (which, in the assembled configuration, can align with the center 111 of the base 110). The center inner post 142*a* can engage the center cylindrical socket 148*a*, as shown. In other aspects, however, additional inner post assemblies 140 may extend from the base cover 175, or none of the inner post assemblies 140 may extend from the base cover 175.

Figure 4B:
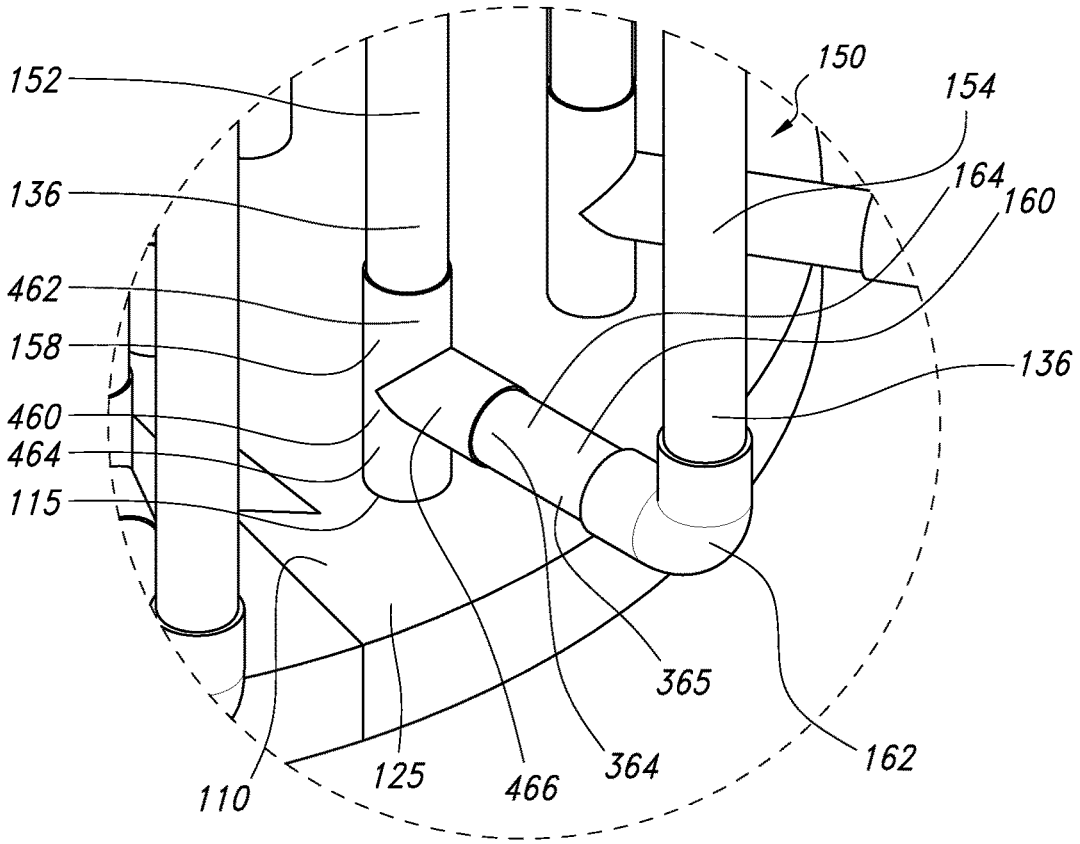
FIG. 4B is a top perspective view of Detail 4B of FIG. 2.

FIG. 4B illustrates a detail view of one of the outer post assemblies 150 mounted to the base 110, taken from detail 4B of FIG. 2. As shown, the outer post assembly 150 can comprise the tee socket 158, the post connector 160, the primary outer post 152, and the secondary outer post 154. The tee socket 158 can define an arm 460 comprising a first arm section 462 and a second arm section 464 opposite and concentric with the first arm section 462. The tee socket 158 can further define a leg 466 extending from the arm 460, wherein the leg 466 can be oriented substantially perpendicular to the arm 460. According to example aspects, the second arm section 464 can engage a corresponding one of the post openings 115 formed in the corresponding base section 125, and the first arm section 462 can extend substantially upward, relative to the orientation shown, and away from the base section 125. The first arm section 462 can define the first tee opening 358 (shown in FIG. 3), and the lower post end 136 of the primary outer post 152 can extend into the first tee opening 358 to engage the first arm section 462 of the tee socket 158. Furthermore, the leg 466 can define the second tee opening 359 (shown in FIG. 3). The post connector 160 can comprise the straight fitting 164, and the first straight fitting end 364 thereof can extend into the second tee opening 359 to engage the leg 466 of the tee socket 158. The post connector 160 can further define the elbow fitting 162, and the second straight fitting end 365 of the straight fitting 164 can engage the second elbow opening 363 (shown in FIG. 3) of the elbow fitting 162 to connect the elbow fitting 162 to the tee socket 158. Finally, the lower post end 136 of the secondary outer post 154 can engage the first elbow opening 362 (shown in FIG. 3) of the elbow fitting 162 to connect the secondary outer post 154 to the tee socket 158. As such, the secondary outer post 154 can be substantially cantilevered from the tee socket 158, as shown, and the secondary outer post 154 can be substantially parallel to the primary outer post 152.

Figure 5:
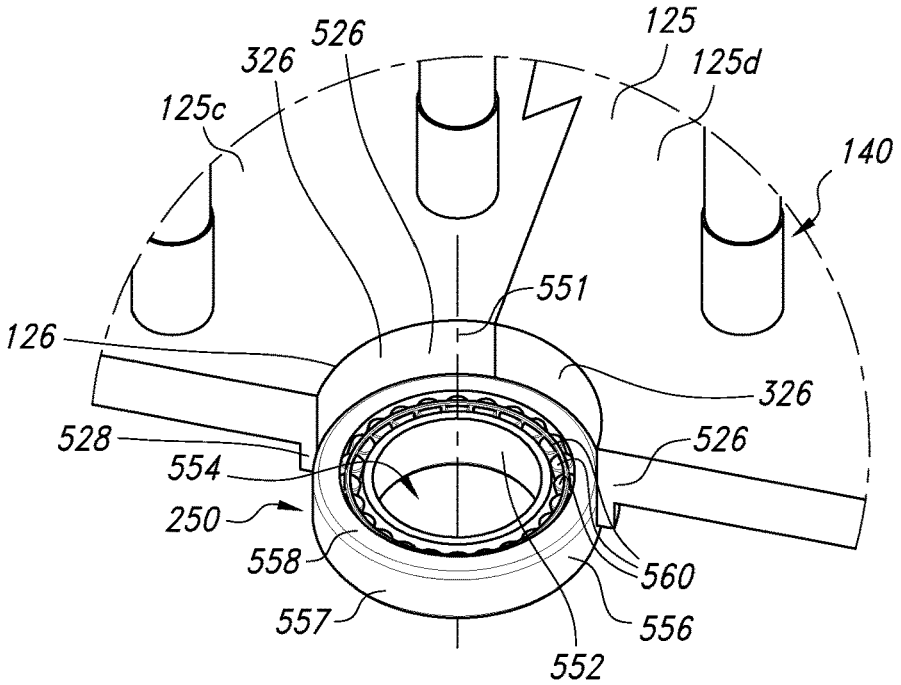
FIG. 5 is a top perspective view of a rotation mechanism of the drying rack of FIG. 1A.

FIG. 5 illustrates the engagement of the base sections 125 with the rotation mechanism 250, according to example aspects. In the present FIG. 5, the third and fourth base sections 125*c,d* are shown, and the first and second base sections 125*a,b* (shown in FIG. 1A) are removed for visibility of the rotation mechanism 250. Example aspects of the rotation mechanism 250 can comprise an inner ring 552, an outer ring 556, and a plurality of bearings 560 (or any other suitable rolling/sliding mechanisms) oriented between the inner and outer rings 552,556, such that the outer ring 556 can rotate on the bearings 560 relative to the inner ring 552, as described in further detail below with respect to FIG. 7. As shown, the inner ring 552 can define a rotation axis 551 through a center opening 554 thereof. In the present aspect, the outer ring 556 of the rotation mechanism 250 can be substantially concentric with the rotation axis 551. Furthermore, the outer ring 556 can define a cylindrical outer surface 557 and a substantially planer and annular top surface 558, as shown. In other aspects, however, the rotation mechanism 250 can define any other suitable configuration know in the art configured to allow the base 110 to rotate, pivot, swivel, or turn relative to the pedestal 230. For example, in a particular aspect, the rotation mechanism 250 may comprise a central pivot rod configured to rotate relative to the pedestal 230, and the base 110 can be mounted to the central pivot rod for rotation therewith relative to the pedestal 230.

As described, each of the first, second, third, and fourth base sections 125*a,b,c,d* can define the arcuate inner end sidewall 326 formed at the corresponding inner end 126 thereof. According to example aspects, each of the inner end sidewalls 326 can generally define an upper sidewall region 526 and a lower sidewall region 528. As shown, the lower sidewall region 528 of each inner end sidewall 326 can be configured to abut the cylindrical outer surface 557 of the outer ring 556. In example aspects, when all of the base sections 125 are connected together to define the base 110 (shown in FIG. 1A), the arcuate inner end sidewalls 326 can together define an annular inner base sidewall 820 (shown in FIG. 8). According to example aspects, there may be a friction fit between the inner base sidewall 820 and the outer ring 556 to couple the base 110 to the rotation mechanism 250. In other aspects, the outer ring 556 may snap into the base 110 to secure the outer ring 556 to the base 110. Some aspects can further or alternatively comprise one or more fasteners for coupling the base 110 to the rotation mechanism 250, including, but not limited to, adhesives, screws, rivets, bolts, welding, and the like. Moreover, when all of the base sections 125 are connected together to define the base 110, the upper sidewall region 526 of the inner end sidewalls 326 of the second, third, and fourth base sections 125*b,c,d* can abut the base cover sidewall 276 (shown in FIG. 2) of the base cover 175 (shown in FIG. 1A) of the first base section 125*a*. In example aspects, the base cover 175 of the first base section 125*a* can be positioned over, and may be configured to rest on, the top surface 558 of the outer ring 556 to cover the rotation mechanism 250 and prevent interference from external factors (e.g., dust, moisture, human interference, and the like). In other aspects, the base 110 may not comprise the base cover 175, and the rotation mechanism 250 can be exposed. Furthermore, other aspects of the drying rack 100 (shown in FIG. 1A) may not comprise the rotation mechanism 250 and/or the pedestal 230 (shown in FIG. 2).

Figure 6:
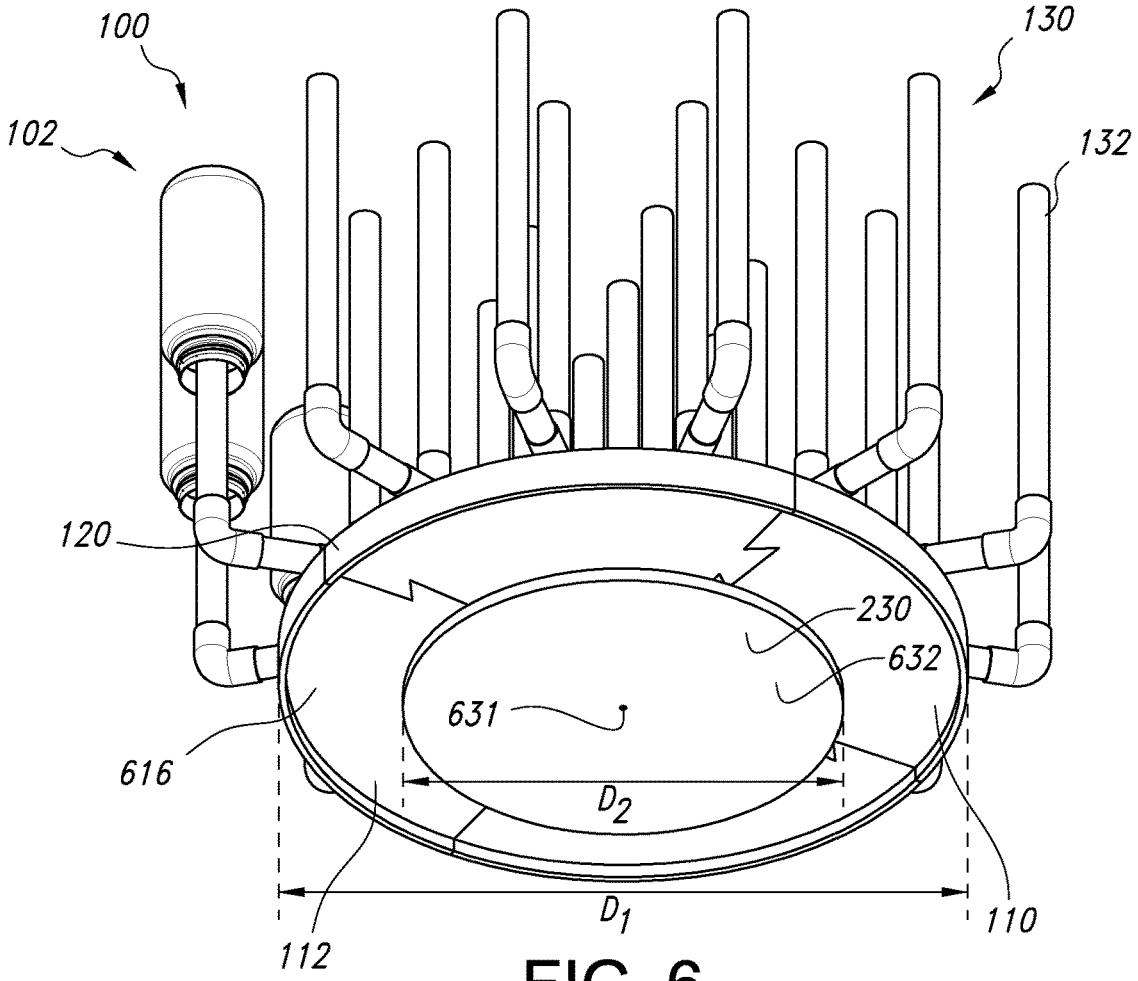
FIG. 6 is a bottom perspective view of the drying rack of FIG. 1A.

FIG. 6 illustrates a bottom perspective view of the drying rack 100, according to an example aspect of the present disclosure. As shown, the pedestal 230 can be substantially circular in shape and can define a pedestal diameter $D_2$ that can be less than the base diameter $D_1$ of the base 110. In other aspects, the pedestal diameter $D_2$ can be about equal to or greater than the base diameter $D_1$. A center 631 of the pedestal 230 can be substantially aligned with the center 111 (shown in FIG. 1B) of the base 110. According to example aspects, the rotation mechanism 250 (shown in FIG. 2) can be coupled to the pedestal 230, and the base 110 can be mounted on the rotation mechanism 250 as described above, such that the base 110 can be supported above the pedestal 230 and can be configured to rotate relative to the pedestal 230. Example aspects of the pedestal 230 can be configured to rest on the support surface to support the base 110 above the support surface. For example, in some aspects, as shown, the pedestal 230 can define a substantially planar bottom pedestal surface 632 configured to engage the support surface. According to example aspects, the base 110 can define the outer base sidewall 120 extending substantially downward, relative to the orientation shown, from the base body 112. As described above, in example aspects, the outer base sidewall 120 can extend past the lower surface 616 of the base body 112 in the direction of the pedestal 230. In some example aspects, when the pedestal 230 is resting on the support surface, the outer base sidewall 120 may extend nearly to the support surface without touching the support surface. In such aspects, the pedestal 230 may be substantially hidden from view by the outer base sidewall 120, but the base 110 can be free to rotate relative to the pedestal 230 without interference from the support surface. The pedestal 230 can be formed from any material known in the art suitable for supporting the base 110 above the support surface. For example, the pedestal 230 can be formed from plastic, wood, metal, a composite, or the like.

Figure 7:
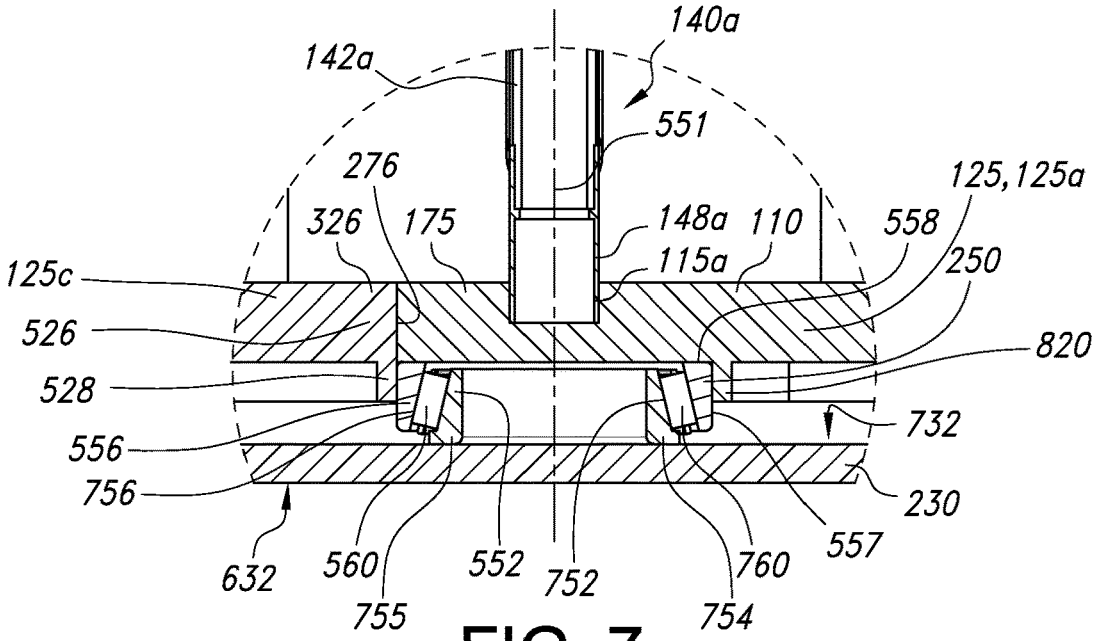
FIG. 7 is cross-sectional view of the rotation mechanism of FIG. 5 taken along line 7-7 of FIG. 1B.

FIG. 7 illustrates a cross-sectional view of the base 110 assembled with the rotation mechanism 250 and pedestal 230. As shown, the first base section 125*a* can define the base cover 175, and the center inner post assembly 140*a* can be mounted to the base cover 175. For example, the center cylindrical socket 148*a* of the center inner post assembly 140*a* can engage the center post opening 115*a* formed in the base cover 175. Moreover, as described above with reference to FIG. 5, example aspects of the rotation mechanism 250 can comprise the inner ring 552, the outer ring 556, and the bearings 560 received therebetween. The outer ring 556 can rotate on the bearings 560 relative to the inner ring 552. As shown, the outer ring 556 can define the cylindrical outer surface 557 and the annular top surface 558. The outer ring 556 can further define an angled inner surface 756. In the present aspect, the base cover 175 of the first base section 125*a* can be configured to rest on the annular top surface 558 of the outer ring 556 to completely cover the rotation mechanism 250. The upper sidewall region 526 of each of the inner end sidewalls 326 of the first, second, third and fourth base sections 125*a,b,c,d* (second and fourth base 125*b,d* sections show in FIG. 1A), can be configured to abut the base cover sidewall 276 of the base cover 175, as shown. Furthermore, the lower sidewall region 528 of each of the inner end sidewalls 326 can be configured to abut the cylindrical outer surface 557 of the outer ring 556, as shown. As described above, when all of the base sections 125 are assembled together to define the base 110, the inner end sidewalls 326 of the base sections 125 can define the annular inner base sidewall 820 (shown in FIG. 8). In example aspects, the base 110 can be secured to the rotation mechanism 250 by a friction fit between the inner base sidewall 820 and the outer ring 556. As described above, in some aspects, additional or alternative fasteners can be provided for securing the base 110 to the rotation mechanism 250.

In some aspects, the plurality of bearings 560 of the rotation mechanism 250 can be joined together to define a bearing ring 760. Furthermore, in some example aspects, as shown, the outer ring 556 can define the angled inner surface 756 and the inner ring 552 can define an angled outer surface 752, as shown. The inner ring 552 can further define a lower flange 754 extending radially outward, relative to the rotation axis 551, at a lower end 755 of the inner ring 552. The bearing ring 760 can be sandwiched between the angled inner surface 756 of the outer ring 556 and the angled outer surface 752 of the inner ring 552, and further, the bearing ring 760 can be supported on the lower flange 754 of the inner ring 552, as shown. In some aspects, the components of the rotation mechanism 250 (e.g., the inner ring 552, the outer ring 556, and the bearing ring 760) can be coupled together by a friction fit between the components. In other aspects, the rotation mechanism 250 can additionally or alternatively comprise one or more fasteners for coupling the inner ring 552, outer ring 556, and bearing ring 760 together, including, but not limited to, adhesives, screws, rivets, bolts, welding, and the like.

Additionally, according to example aspects, the rotation mechanism 250 can be secured to the pedestal 230 and can be configured to support the base 110 rotatably above the pedestal 230, as shown. In example aspects, the pedestal 230 can define the substantially planar bottom pedestal surface 632 configured to engage the support surface, and can further define a substantially planar top pedestal surface 732 opposite the bottom pedestal surface 632. According to the present aspect, the lower end 755 of the inner ring 552 of the rotation mechanism 250 can engage the top pedestal surface 732, as shown. In example aspects, the inner ring 552 can be fixedly secured to the top pedestal surface 732, such that the outer ring 556 of the rotation mechanism 250 and base 110 can rotate as the inner ring 552 and pedestal 230 remain stationary. For example, in some aspects, the inner ring 552 can be secured to the pedestal 230 by an adhesive, such as glue. In other aspects, the inner ring 552 may snap into the pedestal 230 to secure the inner ring 552 to the pedestal 230. In other aspects, the inner ring 552 can be secured to the pedestal 230 by welding, screws, rivets, pins, or any other suitable fastener known in the art. Furthermore, in other aspects, the pedestal 230 can define a hole or a recess formed therein which can be configured to receive the rotation mechanism 250, or a portion thereof, to secure the rotation mechanism 250 to the pedestal 230. In some aspects, a non-slip mat or coating can be applied to the bottom pedestal surface 632 of the pedestal 230 to prevent the pedestal 230 from slipping on the support surface. However, other aspects of the pedestal 230 may not comprise the non-slip mat or coating. In some aspects, the pedestal 230 itself can be formed from a non-slip material.

Figure 8:
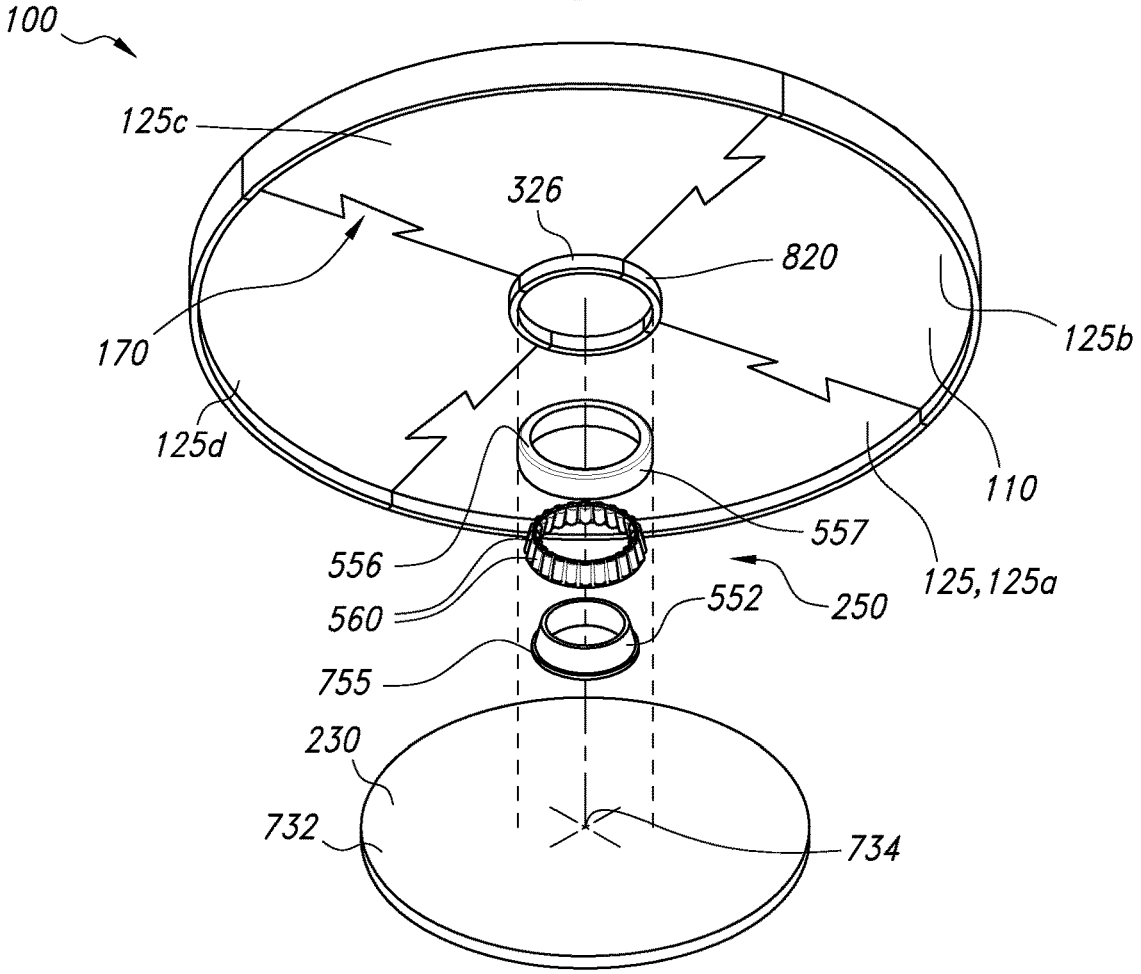
FIG. 8 is an exploded view of the rotation mechanism of FIG. 5.

FIG. 8 illustrates an exploded view of the drying rack 100 comprising the rotation mechanism 250, base 110, and pedestal 230. As shown, when all of the base sections 125 (e.g., the first, second, third and fourth base sections 125*a, b,c,d*) are assembled together by the corresponding dovetail joints 170, the inner base sidewall 820 can be defined by the inner end sidewalls 326 of the base sections 125. The rotation mechanism 250 can comprise the inner ring 552, outer ring 556, and bearings 560, wherein the outer ring 556 can rotate on the bearings 560 relative to the inner ring 552. The inner ring 552 can engage the pedestal 230, and the outer ring 556 can engage the base 110, such that the base 110 can rotate relative to the pedestal 230. For example, the inner base sidewall 820 of the base 110 can engage the cylindrical outer surface 557 of the outer ring 556 to secure the base 110 thereto. Moreover, as shown, example aspects of the pedestal 230 can define the top pedestal surface 732 opposite the bottom pedestal surface 632 (shown in FIG. 6), and the top pedestal surface 732 can define a rotation mechanism mounting region 734. The lower end 755 of the inner ring 552 can be coupled to the top pedestal surface 732 at the rotation mechanism mounting region 734 to secure the rotation mechanism 250 to the pedestal 230. It should be noted that, in other aspects, the inner ring 442 can be coupled to the base 110 and the outer ring 556 can be coupled to the pedestal 230.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A drying rack comprising:

a rotation mechanism;

a base rotatably coupled to the rotation mechanism and comprising a plurality of base sections, a first one of the plurality of base sections comprising a base cover, the base cover covering the rotation mechanism; and a plurality of mounting post assemblies mounted to the base, each of the mounting post assemblies comprising at least one mounting post, the mounting post assemblies comprising:

an inner post assembly comprising an inner post; and an outer post assembly comprising a primary outer post and a secondary outer post, wherein each of the inner post, primary outer post, and secondary outer post are configured to support an object above the base.

2. The drying rack of claim 1, wherein the base comprises a plurality of post openings, each of the mounting post assemblies configured to engage a one of the post openings.

3. The drying rack of claim 1, wherein the inner post assembly further comprising a cylindrical socket, the cylindrical socket engaging the base, the inner post engaging the cylindrical socket.

4. The drying rack of claim 1, wherein:

the outer post assembly further comprises a tee socket, the tee socket engaging the base;

the tee socket defines a first tee opening and a second tee opening;

the primary outer post engages the first tee opening;

the outer post assembly further comprises a post connector engaging the second tee opening; and the secondary outer post engages the post connector.

5. The drying rack of claim 4, wherein the post connector comprises a straight fitting and an elbow fitting coupled to the straight fitting, the straight fitting engaging the second tee opening, and the elbow fitting engaging the secondary outer post.

6. The drying rack of claim 1, further comprise a pedestal, wherein the base is rotatably coupled to the pedestal by the rotation mechanism.

7. The drying rack of claim 1, wherein the base defines a base circumference and at least one of the mounting posts is oriented outside of the base circumference.

8. The drying rack of claim 7, wherein each of the inner post and primary outer post is oriented within the base circumference, and the secondary outer post is oriented outside of the base circumference.

9. A rotatable drying rack comprising:

a pedestal configured to rest on a support surface;

a base;

a rotation mechanism rotatably coupling the base to the pedestal, wherein the base is configured to rotate relative to the pedestal; and a mounting post assembly mounted to the base, the mounting post assembly comprising a mounting post configured to support a wet object above the base for drying;

wherein the base comprises a plurality of base sections, a first one of the plurality of base sections comprising a base cover configured to cover the rotation mechanism.

10. The rotatable drying rack of claim 9, wherein the rotation mechanism comprises an inner ring, an outer ring, and a plurality of bearings oriented between the inner ring and outer ring, the outer ring configured to rotate on the bearings relative to the inner ring.

11. The rotatable drying rack of claim 10, wherein the base engages the outer ring and the pedestal engages the inner ring.

12. The rotatable drying rack of claim 9, wherein:

the mounting post assembly is an inner post assembly comprising an inner post;

the rotatable drying rack further comprising an outer post assembly mounted to the base, the outer post assembly comprising a primary outer post and a secondary outer post; and each of the inner post, primary outer post, and secondary outer post is configured to support a wet object above the base for drying.

13. The rotatable drying rack of claim 12, wherein:

the inner post assembly comprises a cylindrical socket configured to couple the inner post to the base; and the outer post assembly comprises a tee socket configured to couple the primary and secondary outer posts to the base.

14. The rotatable drying rack of claim 9, further comprising a stabilizing sleeve mounted to the mounting post.

15. The rotatable drying rack of claim 9, wherein:

the base defines a base body, the base body defining an upper surface; and the rotatable drying rack further comprises a protective mat resting on the upper surface of the base body.

16. A method of drying wet objects comprising:

providing a drying rack, the drying rack comprising a base rotatably coupled to a pedestal and a plurality of mounting post assemblies mounted to the base, wherein the base comprises a plurality of base sections, a first one of the plurality of base sections comprising a base cover;

mounting a first wet object to a first one of the plurality of mounting post assemblies;

rotating the base relative to the pedestal to reposition a second one of the plurality of mounting post assemblies closer to a user, the base rotatably coupled to the pedestal by a rotation mechanism, the base cover covering the rotation mechanism;

mounting a second wet object to the second one of the plurality of mounting post assemblies; and removing each of the first wet object and second wet object from the drying rack once the first and second wet objects have dried.

17. The method of claim 16, wherein the plurality of mounting post assemblies comprise an inner post assembly and an outer post assembly, the inner post assembly comprising an inner post, the outer post assembly comprising a primary outer post and a secondary outer post.

18. The method of claim 16, further comprising rotating the base relative to the pedestal to increase air flow around the first and second wet objects.

* * * * *